United States Patent [19]

Jacobs

[11] 4,399,669

[45] Aug. 23, 1983

[54] MOTOR COMPRESSOR UNIT

[75] Inventor: John J. Jacobs, Pulaski, N.Y.

[73] Assignee: Carrier Corporation, Syracuse, N.Y.

[21] Appl. No.: 242,855

[22] Filed: Mar. 12, 1981

Related U.S. Application Data

[63] Continuation of Ser. No. 7,867, Jan. 29, 1979, abandoned.

[51] Int. Cl.[3] ..... F25B 43/02

[52] U.S. Cl. ..... 62/469; 62/296; 62/508; 62/196 R; 417/902

[58] Field of Search ..... 62/469, 508, 196, 296; 417/902

[56] References Cited

U.S. PATENT DOCUMENTS

| | | | |
|---|---|---|---|
| 2,084,341 | 10/1934 | Hornaday | 62/469 X |
| 2,445,527 | 7/1948 | Hirsch | 62/508 X |
| 2,979,917 | 4/1961 | Meagher | 62/196 |
| 3,021,995 | 2/1962 | Neubauer | 417/902 |
| 3,926,009 | 12/1975 | Parker et al. | 62/296 |

FOREIGN PATENT DOCUMENTS

| | | | |
|---|---|---|---|
| 2261829 | 6/1973 | Fed. Rep. of Germany | 62/469 |
| 41-18294 | 12/1966 | Japan | 62/469 |
| 401864 | 8/1971 | U.S.S.R. | 62/469 |

*Primary Examiner*—Albert J. Makay
*Assistant Examiner*—Henry Bennett
*Attorney, Agent, or Firm*—Donald F. Daley; David J. Zobkiw

[57] ABSTRACT

A suspension system for a motor compressor unit mounted within a hermetically sealed shell. The shell defines at least one chamber filled with refrigerant suction gas and a second chamber filled with refrigerant discharge gas. The compressor's cylinder block includes a wall member extending into contact with the interior surface of the shell to support the unit in a vertical plane taken through the shell.

4 Claims, 4 Drawing Figures

MOTOR COMPRESSOR UNIT

This application is a continuation of application Ser. No. 007,867, filed Jan. 29, 1979, now abandoned.

BACKGROUND OF THE INVENTION

This invention relates to a suspension and seal system for a refrigeration motor compressor unit, and in particular, to such a system particularly suitable for use in hermetically sealed units wherein refrigerant gas at discharge pressure substantially surrounds the motor and compressor of the unit.

It is well recognized that a motor and compressor mounted within a hermetically sealed shell must be resiliently supported to prevent noise transmission from the interior of the shell to the exterior thereof. In addition, the support or suspension system must function to minimize or eliminate extensive movement of the motor and compressor in the shell such as might occur due to torsional forces developed during start-up of the unit. It is essential that excessive movement of the motor and compressor within the shell be prevented to prevent damage to components thereof, such as the motor windings and lubricating oil pump.

It has been found that the energy efficiency of a motor compressor unit can be significantly increased by filling the chamber in which the motor and compressor are mounted with refrigerant gas at discharge pressure. Heretofore, it has been the practice to fill the chamber with gas at suction pressure, with the gas cooling the motor's windings prior to entry into the compressor's cylinders. In the present arrangement, the suction gas is not used for motor cooling, but rather is led to a relatively small chamber in direct flow communication with the compressor cylinder. The temperature of the gas is thus maintained at a minimum prior to compression. To insure minimum heat transfer between the relatively high temperature refrigerant gas contained within the major portion of the shell and the relatively low temperature refrigerant gas contained within the realatively small chamber adjacent the cylinder, it is necessary to provide a seal.

The present invention particularly relates to a suspension system which, not only supports the motor and compressor within a hermetically sealed shell, but in addition, provides a seal for physically separating suction gas from discharge gas and for minimizing heat transfer between the suction and discharge gas.

SUMMARY OF THE INVENTION

It is, therefore, an object of this invention to support a motor and a compressor within a hermetically sealed shell having a first chamber filled with relatively high temperature discharge gas and a second chamber filled with relatively low temperature suction gas.

It is another object of this invention to utilize portions of the compressor as support members for the motor and compressor.

It is a further object of this invention to dampen the movement of a motor and a compressor within a hermetically sealed shell, and in addition to seal the suction and discharge gas chambers of the shell relative to each other.

These and other objects of the present invention are attained with a motor compressor unit comprising a compressor including a compressor block having a central body and at least one cylinder portion extending axially outward therefrom along an axis defined by the cylinder portion, a motor for driving the compressor and supported thereby, and a hermetically sealed shell encapsulating the compressor and the motor. The motor compressor unit further comprises a flange projecting from the cylinder portion of the compressor block, generally perpendicular to the cylinder portion, and extending into contact with an interior surface of the shell to separate the shell into first and second pressure chambers, and wherein a portion of the shell surface in contact with the flange is located directly therebelow to support the flange, the compressor, and the motor in a vertical plane extending through the shell.

DESCRIPTION OF THE PREFERRED EMBODIMENT

Figure 1:
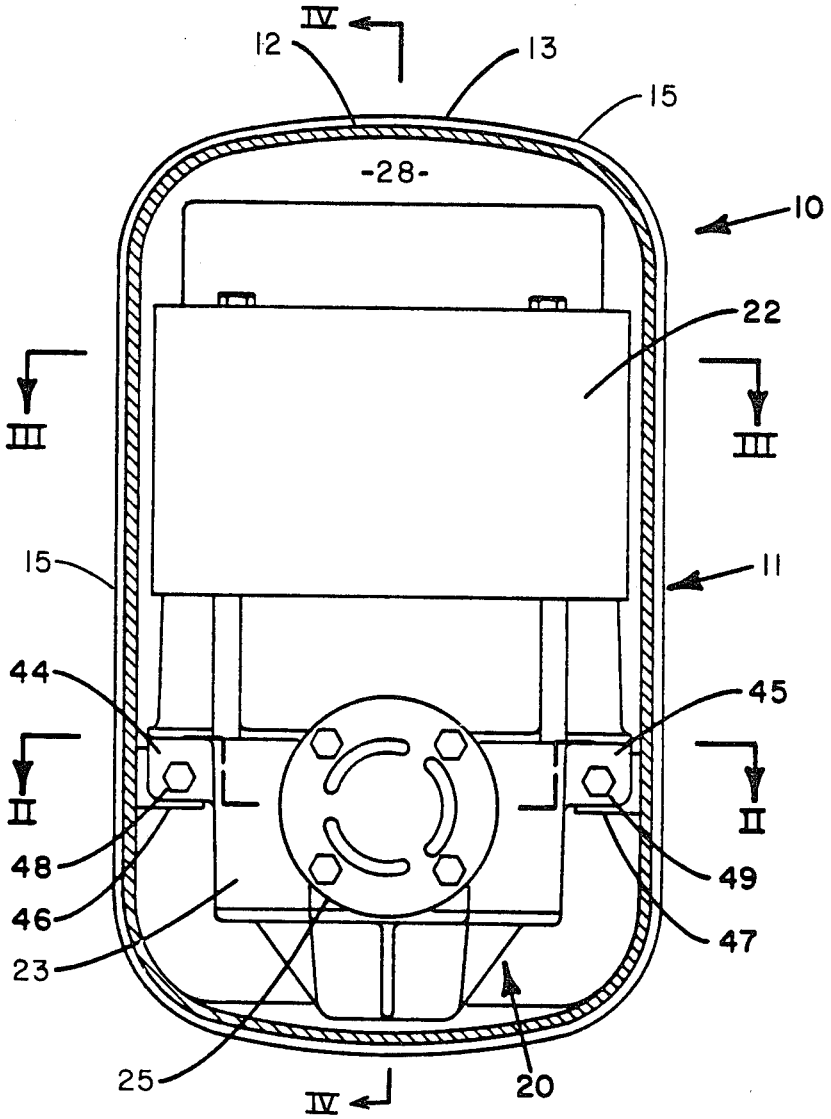
FIG. 1 is a longitudinal plane view, partially in section, of the motor compressor unit mounted within the shell.
Figure 3:
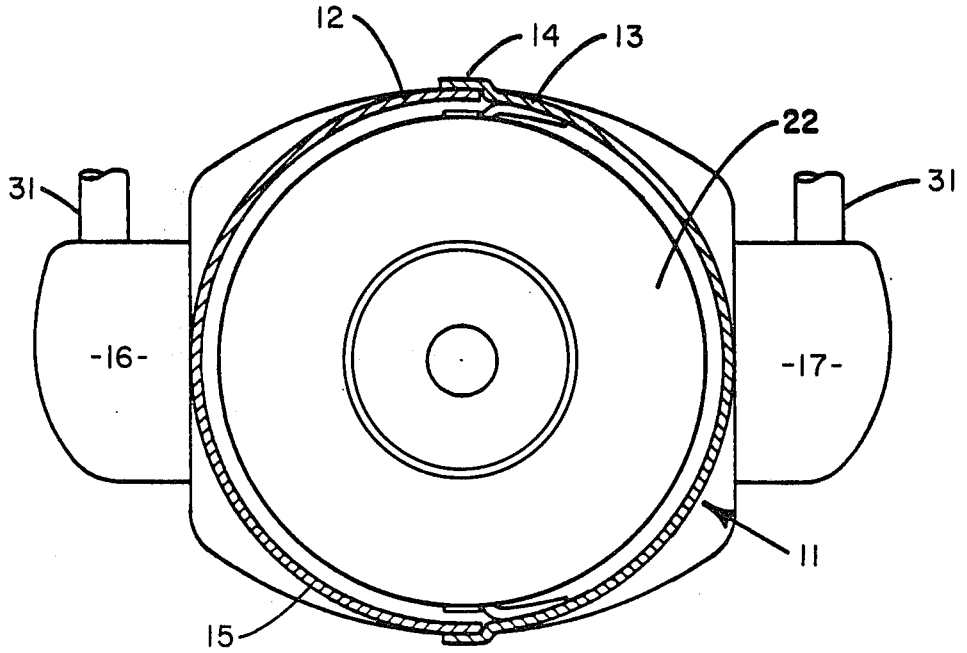
FIG. 3 is a further sectional view taken along line III—III of FIG. 1.
Figure 2:
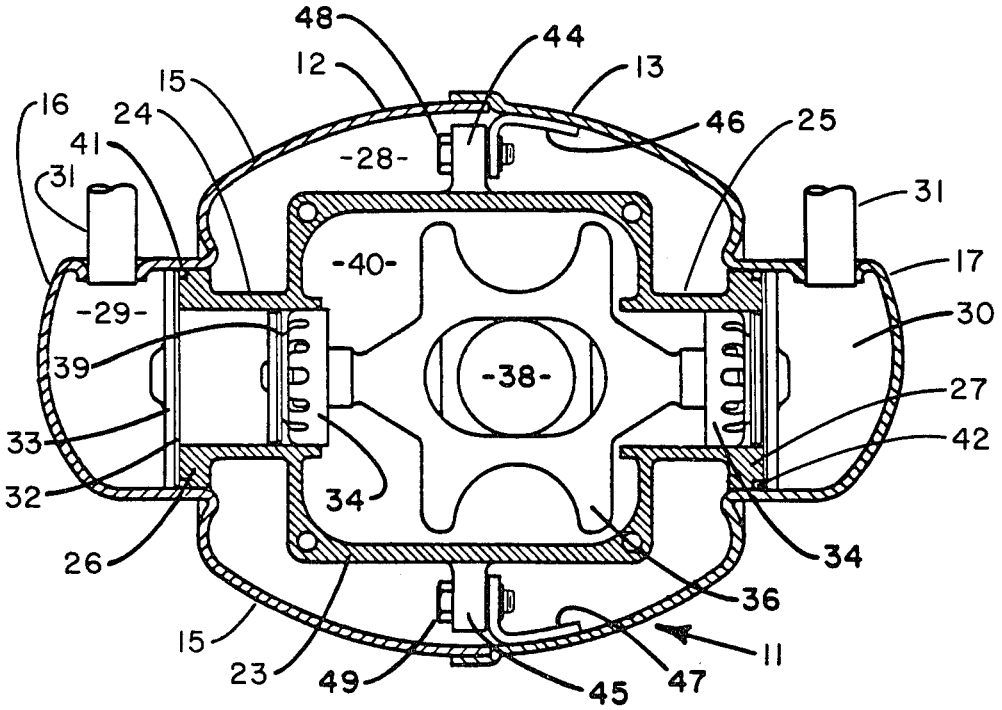
FIG. 2 is a sectional view taken along line II—II of FIG. 1.

Referring now to the drawings there is disclosed a preferred embodiment of the present invention. In referring to the various figures of the drawings, like numerals shall refer to like parts.

As so formed, shell 11 includes a relatively large central, or head portion 15 and generally cylindrically shaped, left and right opposed ear portions 16 and 17 extending outward from lower left and lower right areas of the head portion of the shell.

Referring to the various Figures, there is illustrated a motor compressor unit generally designated 10 including hermetically sealed shell generally designated 11. The shell comprises first and second portions 12 and 13 sealed together, as by welding, along a vertically extending circumferential.

Motor compressor unit 10 further includes a reciprocating compressor 20 and a motor 22 connected thereto in driving relationship. Compressor 20, in turn, includes central body 23, left and right cylinder portions 24 and 25, and left and right support flanges 26 and 27. Central body 23 of compressor 20 is located within head portion 15 of shell 11, left cylinder portion 24 of the compressor axially extends outward from central body 23 into left ear portion 16 of the shell, along a horizontal axis defined by the left cylinder portion, and right cylinder portion 25 of compressor 20 axially extends outward from the central body thereof into right ear portion 17 of shell 11, co-axial with but opposite from left cylinder portion 24. Left support flange 26 extends vertically outward from left cylinder portion 24, of compressor 20, within ear portion 16 of shell 11; and right support flange 27 extends vertically outward from right cylinder portion 25 of the compressor within right ear portion 17 of the shell. Left and right support flanges 26 and 27 separate the interior of shell 11 into a central region or chamber 28 and separate left and right, opposed, peripheral regions or chambers 29 and 30.

Figure 4:
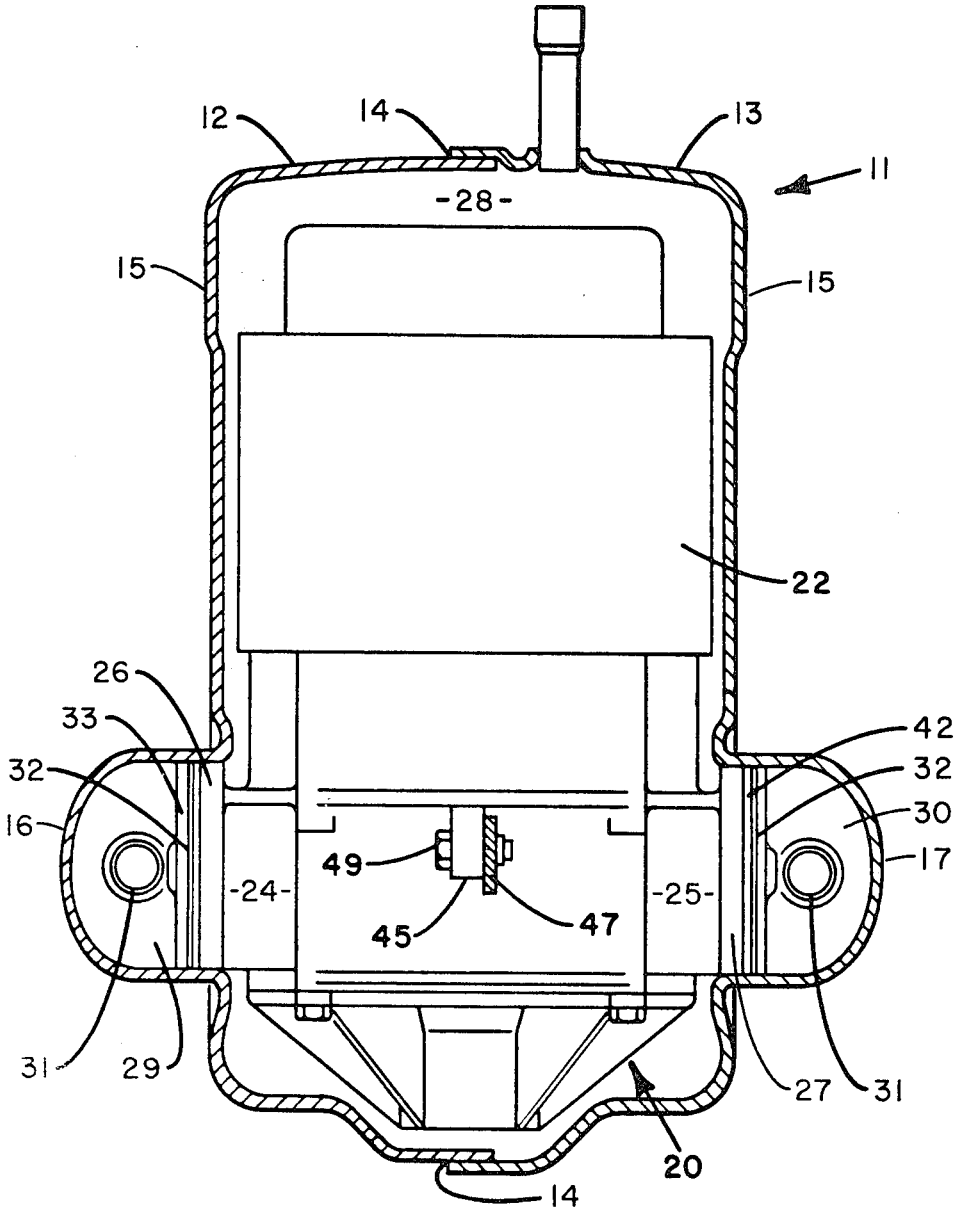
FIG. 4 is a longitudinal side view, partially in section, of the motor compressor unit and shell shown in FIGS. 1 through 3, with the cross sectional portions of FIG. 4 taken along line IV—IV of FIG. 1.

At the same time, support flanges 26 and 27 cooperate with interior surfaces of shell 11 to support compressor 20 and motor 22 therewith, in vertical planes extending through the shell. To elaborate, with particular reference to FIG. 4, the interior surface of left ear portions 16 of shell 11 defines a left support area directly below and supporting left support flange 26 to support compressor 20 and motor 22 within shell 11, and the interior surface of right ear portion 17 of the shell defines a right support area directly below and supporting right support flange 27 to further support the compressor and the motor within shell 11. Refrigerant gas to be compressed is delivered into chambers 29 and 30 via suction lines 31. As is well recognized, suction lines 28 are connected to the evaporator (not shown) of a conventional refrigeration unit. The flow of gas from chambers 29 and 30 into cylinder portions 24 and 25 is controlled by the operation of suction valve 32 mounted between valve plate 29 and a flanges 26 and 27.

As is well known to those skilled in the art, the refrigerant gas delivered into each cylinder portion 24 and 25 is compressed by the reciprocating movement of piston 34 therewithin. Pistons 34 are operatively connected to a scotch yoke mechanism generally designated 36 which moves in response to rotation of shaft 38 to provide reciprocating movement of pistons 34. The compressed refigerant gas in each cylinder portion will open discharge valves 39 and flow into chamber 40 defined by central body 23 of compresser 20. The refrigerant gas will pass upwardly from chamber 40 through the motor, cooling same, and thence into central region 28 of shell 11.

Region 28 contains refrigerant gas at discharge pressure and temperature. The gas flows to the refrigerant condenser (not shown) from motor compressor unit 10 via a suitable discharge tube provided at the top of shell 11 in communication with region 28.

It has been found that improved energy efficiency may be obtained from a reciprocating compressor by maintaining the temperature of the suction gas delivered into the cylinder portions at a relatively low level. Heretofore, it has been the common practice to employ the suction gas to cool the motor windings prior to its delivery into the cylinders of the compressor. In flowing through the windings, the suction gas temperature increases, thereby reducing the overall efficiency of the compressor unit.

In the present arrangement, in order to obtain maximum efficient compressor operation, it is extremely important that the suction gas be maintained completely separate from the discharge gas to prevent heat transfer therebetween. Thus, the suction gas is delivered directly into low pressure regions 29 and 30, and these regions are sealed from central, high pressure region 30 by left and right support flanges 26 and 27, planar members, which may be defined by valve plates 33, and left and right o- rings 41 and 42. In particular, left and right support flanges 26 and 27 preferably extend into contact with the interior surface of shell 11. Planar members 33 are located adjacent to left and right support flanges 26 and 27 axially outward therefrom, and the planar members extend substantially parallel to the left and right support flanges. The interior surface of shell 11, support flanges 26 and 27, and planar members 33 define left and right annular cavities, and left and right o- rings 41 and 42 are disposed within these cavities, respectively, preventing the flow of refrigerant between low pressure regions 29 and 30 and high pressure region 28.

As previously mentioned, left and right support flanges 26 and 27 function to support compressor 20 and motor 22 within shell 11. Preferably, the support and suspension system for motor compressor unit 10 further includes a pair of equally spaced lugs 44, 45 extending from central body 23 of compressor 20. Each lug member 44, 45 is associated with a corresponding accepting member 46, 47 suitably connected to the interior surface of shell 11 as for example, by welding. Joining means, such as bolts 48, 49 are employed for connecting each lug to its associated accepting member. The sub-assembly thus formed rigidly anchors the motor and compressor within the shell for preventing rotational or horizontal movement of the motor compressor and relative to the shell.

The suspension system thus described positively maintains the motor and the compressor in a fixed location within shell 11. Since the compressor block and surrounding shell are used in forming the suspension system, a relatively simple, yet highly reliable suspension system is achieved. Further, elements of the suspension system are additionally used in the seal used to segregate chambers having relatively high pressure and temperature refrigerant gas, from chambers having relatively low pressure and temperature refrigerant gas.

The present suspension and seal system for the motor compressor unit achieves a sealing function and minimizes heat transfer between a first chamber filled with refrigerant gas at discharge temperature and pressure and a second chamber filled with gas at suction temperature and pressure, and effectively supports and suspends the motor and compressor within the shell to prevent damage thereto by preventing excessive movement of the motor and compressor within the shell.

While a preferred embodiment of the present invention has been described and illustrated the invention should not be limited thereto but may be otherwise embodied within the scope of the following claims.

What is claimed is:

1. A motor-compressor unit comprising:

a shell including a central head portion, a generally cylindrical left ear portion extending outward from a lower left area of the head portion, and a generally cylindrical right ear portion extending outward from a lower right area of the head portion, opposite the left ear portion;

a compressor located within the shell to compress a vapor; and a motor supported by the compressor within the shell and connected to the compressor to drive the compressor;

the compressor including a central body located within the head portion of the shell, a left cylinder portion axially extending outward from the central body of the compressor into the left ear portion of the shell, along a horizontal axis defined by the left cylinder portion, a left support flange extending vertically outward from the left cylinder portion of the compressor, within the left ear portion of the shell, a right cylinder portion axially extending outward from the central body of the compressor into the right ear portion of the shell, co-axial with and opposite from the left cylinder portion of the compressor, and a right support flange extending vertically outward from the right cylinder portion of the compressor, within the right ear portion of the shell;

wherein the left and right support flanges separate the interior of the shell into a central region and separate left and right, opposed peripheral regions, and cooperate with interior surfaces of the left and right ear portions of the shell to support the compressor and the motor therewithin.

2. A motor-compressor unit as defined by claim 1 further including:

an outward planar member located adjacent to the left support flange axially outward thereof, and extending substantially parallel to the left support flange;

an annular cavity defined by the left support flange, the outward planar member, and the interior surface of the shell; and a resilient seal member captured within the annular cavity for preventing vapor flow between the left peripheral region and the central region of the shell.

3. A motor-compressor unit in accordance with claim 2 further including anchoring means joining said motor and compressor to said shell for preventing rotational and horizontal movement of said motor and compressor relative to said shell.

4. A motor-compressor unit as defined by claim 1 wherein:

the interior surface of the left ear portion defines a left support area directly below and supporting the left support flange to support the compressor and the motor within the shell; and the interior surface of the right ear portion of the shell defines a right support area directly below and supporting the right support flange to further support the compressor and the motor within the shell.

* * * * *